US005094354A

United States Patent [19]

Lindner et al.

[11] Patent Number: 5,094,354

[45] Date of Patent: Mar. 10, 1992

[54] COUPLING AND UNCOUPLING DEVICE FOR AN ELECTRICAL CABLE COUPLING AND A MECHANICAL MIDDLE BUFFER COUPLING FOR RAIL-BORNE VEHICLES

[75] Inventors: Harald Lindner; Ernst Hartmann, both of Salzgitter, Fed. Rep. of Germany

[73] Assignee: Scharfenbergkupplung GmbH, Salzgitter, Fed. Rep. of Germany

[21] Appl. No.: 685,438

[22] Filed: Apr. 15, 1991

[30] Foreign Application Priority Data

Apr. 27, 1990 [DE] Fed. Rep. of Germany ..... 4013493

[51] Int. Cl.[5] ..... B61G 5/06

[52] U.S. Cl. ..... 213/1.3; 439/310

[58] Field of Search ..... 213/1.3, 1.6; 280/422; 439/259, 284, 289, 292, 293, 294, 295, 296, 310

[56] References Cited

U.S. PATENT DOCUMENTS 3,385,454 5/1968 Jeffrey et al. ..... 280/422

4,953,726 9/1990 Loutan ..... 213/1.3

*Primary Examiner*—Robert J. Oberleitner

*Assistant Examiner*—Kevin D. Rutherford

*Attorney, Agent, or Firm*—McGlew & Tuttle

[57] ABSTRACT

To couple the initiation and the chronological sequence of a coupling or uncoupling process of a mechanical middle buffer coupling and an electrical cable coupling arranged on it longitudinally displaceably in the direction of the coupling axis with a common rotary drive with the smallest possible amount of control effort and in a reliable manner, a coupling and uncoupling device is provided with a drivable shaft arranged at right angles to the coupling axis. An actuating arm is nonrotatably fastened to the drivable shaft, and the actuating arm extends into a guide rail of the cable coupling and is thus designed as the direct drive member of the cable coupling. The shaft is guided rotatably and longitudinally displaceably in a lower hollow shaft section of a hollow shaft, which consists of a lower, a middle, and an upper hollow shaft section, and the shaft extends beyond the middle hollow shaft section in the upward direction into the zone of the upper hollow shaft section, in which zone the shaft is guided longitudinally displaceably but nonrotatably.

8 Claims, 2 Drawing Sheets

COUPLING AND UNCOUPLING DEVICE FOR AN ELECTRICAL CABLE COUPLING AND A MECHANICAL MIDDLE BUFFER COUPLING FOR RAIL-BORNE VEHICLES

FIELD OF THE INVENTION

The present invention pertains to a coupling and uncoupling device for an electrical cable coupling and a mechanical intermediate buffer coupling for rail-borne vehicles wherein the coupling and uncoupling device can be driven by means of a rotary drive which brings the electrical cable coupling alternatingly into a coupled front end position and an uncoupled rear end position via a gear mechanism and which also actuates a release member of the middle buffer coupling.

BACKGROUND OF THE INVENTION

A gear mechanism consisting of a four-bar linkage forming a Scotch yoke performing reciprocating movements is generally known from the manuscript Getriebelehre I [Kinematics I] by Prof. Dr. B. Dizioglu, TU Braunschweig, 1974, p. 9. A drive arm that is able to rotate around a fixed bearing acts with its other end on a sliding block, which is held linearly displaceably in the guideway of a guide rail. A sliding bar, which is directed at right angles to the guideway and is guided in a fixed bearing, is fastened to the guide rail. Due to this arrangement, transformation of a rotary movement of the drive arm into a longitudinal movement of the guide rail at right angles to its guideway and to the sliding bar fastened to it is achieved. Thus, the guide rail and the sliding bar are arranged in a cross-shaped pattern. During clockwise rotation of the drive arm out of a position that is parallel to the sliding bar through 180°, each point of the sliding bar moves in the axial direction of the sliding bar from a front end position to a rear end position. During further rotation in the same direction, each point of the sliding bar will again move from the rear end position to the front end position, i.e., each point of the sliding bar returns from the front end position into the front end position via the rear end position during each full revolution of the drive arm. Each point of the sliding bar again moves from the rear end position to the front end position during rotation in the opposite direction as well.

The above-mentioned, well-known principle of the Scotch yoke performing reciprocating movement is applied in EP-0,339,348 A1 to the actuating mechanism of an electrical cable coupling for rail-borne vehicles. The manner of coupling and the electrical cable coupling require a separate actuation of the electrical cable coupling and of the release mechanism for the mechanical coupling for each switching cycle, so that when operating the rotary drive of the electrical cable coupling, the operator must decide on and initiate connection, i.e., coupling with the release mechanism, separately in each switching cycle if actuation of the release mechanism is necessary. The non- positive contact between the rotary drive and the cable coupling is to be abolished by arranging the last gear pair of a gear mechanism between the rotary drive and the cable coupling, which gear pair is located in the flux of force, and making it such that it is able to be disengaged.

SUMMARY AND OBJECTS OF THE INVENTION

It is an object of the present invention to design a coupling and uncoupling device of this class for an electrical cable coupling and a mechanical middle buffer coupling in a compact design such that the initiation and the chronological sequence of the coupling and uncoupling process of the mechanical middle buffer coupling and the electrical cable coupling are coupled with each other by using a common drive for actuation in a reliable manner, with a small amount of control effort, especially manual control effort, where the design of the coupling and uncoupling device also permits, if necessary, manual actuation of the cable coupling by simply switching over to special operation, even when the remote-controlled actuation of the lock of the mechanical middle buffer coupling via the rotary drive is maintained.

According to the invention, a coupling and uncoupling device is provided for an electrical cable coupling and a mechanical intermediate buffer coupling for rail-borne vehicles, wherein the coupling and uncoupling device can be driven by means of a rotary drive which brings the electrical cable coupling alternatingly into a coupled front end position or an uncoupled rear end position via a gear mechanism, wherein the arrangement is also intended to actuate a release member of the middle or intermediate buffer coupling. The cable coupling is arranged and guided longitudinally displacably in a direction of the coupling axis of the middle buffer coupling and the gear mechanism is provided with a shaft arranged at right angles to the coupling axis. An actuating arm is non rotatably fastened on the shaft. The actuating arm is provided extending into a guide rail of the cable coupling, the guide rail being arranged at a right angle with respect to the coupling axis and being designed as a direct drive member of the cable coupling. This arrangement consequently provides a kinematic chain in the form of a reciprocating scotch yoke which is well known from kinematics. The invention provides that the shaft is guided rotatably and longitudinally displacably in a lower hollow shaft section of a hollow shaft. The hollow shaft includes the lower hollow shaft section, a middle hollow shaft section and an upper hollow shaft section. A housing part is provided wherein the shaft extends beyond the housing part in a downward direction with a shaft projection and the shaft extends beyond the middle hollow shaft section in the upward direction, into the zone of the upper hollow shaft section in which the shaft is guided longitudinally displacably but non rotatably. The upper hollow shaft section is non rotatably connected to the actuating arm and the lower hollow shaft section is permanently coupled with a rotary drive for torque transmission. An uncoupling lever is provided with a release cam which may be brought into the switching zone of the release member of the mechanical log. The uncoupling lever with the release cam is arranged non rotatably on the lower hollow shaft section. The middle hollow shaft section is provided non rotatably connected to the shaft and is arranged above the lower hollow shaft section. Each of the hollow shaft sections are provided at their respective ends with locking members which permit transmission of torque from the lower hollow shaft section to the upper hollow shaft section, wherein the locking members between the lower hollow shaft section and the middle hollow shaft section can be disengaged by axially displacing the middle hollow shaft section via the shaft 15 in the direction of the upper hollow shaft section, relative to the lower hollow shaft section and against the force of a spring.

Due to the design of the coupling and uncoupling device according to the present invention, the initiation and the movement processes involved in the actuation of the electrical cable coupling and of the mechanical middle buffer coupling are positively coupled in automated normal operation via a shaft or hollow shaft, using a common rotary drive in a reliable manner and with a small amount of control effort, especially manual control effort. This applies to both the coupling process and the uncoupling process. The positive coupling is designed such that it can be abolished if necessary for special operation by simply switching over, namely, by raising the shaft in the axial direction. It is advantageous for performing coupling or uncoupling of the cable coupling and the middle buffer coupling manually in case cf failure of the rotary drive, or to make possible, as before, the remote-controlled release of the mechanical lock of the middle buffer coupling via the rotary drive for applications in which existing electrical cable couplings are not used.

It is a further object of the invention to provide a coupling and uncoupling device for rail vehicles in which electrical cable connections can be made simply and in conjunction with a mechanical intermediate buffer coupling and which allows both automatic controlled connection and also manual coupling of the electrical cables.

Still another object of the invention is to provide a coupling and uncoupling arrangement for rail-borne vehicles which is simple in design, rugged in construction and economical to manufacture.

Advantageous variants of the object of the present invention are also disclosed.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DETAILED DESCRIPTION OF THE PREFERRED EMBODIMENT

Figure 1:
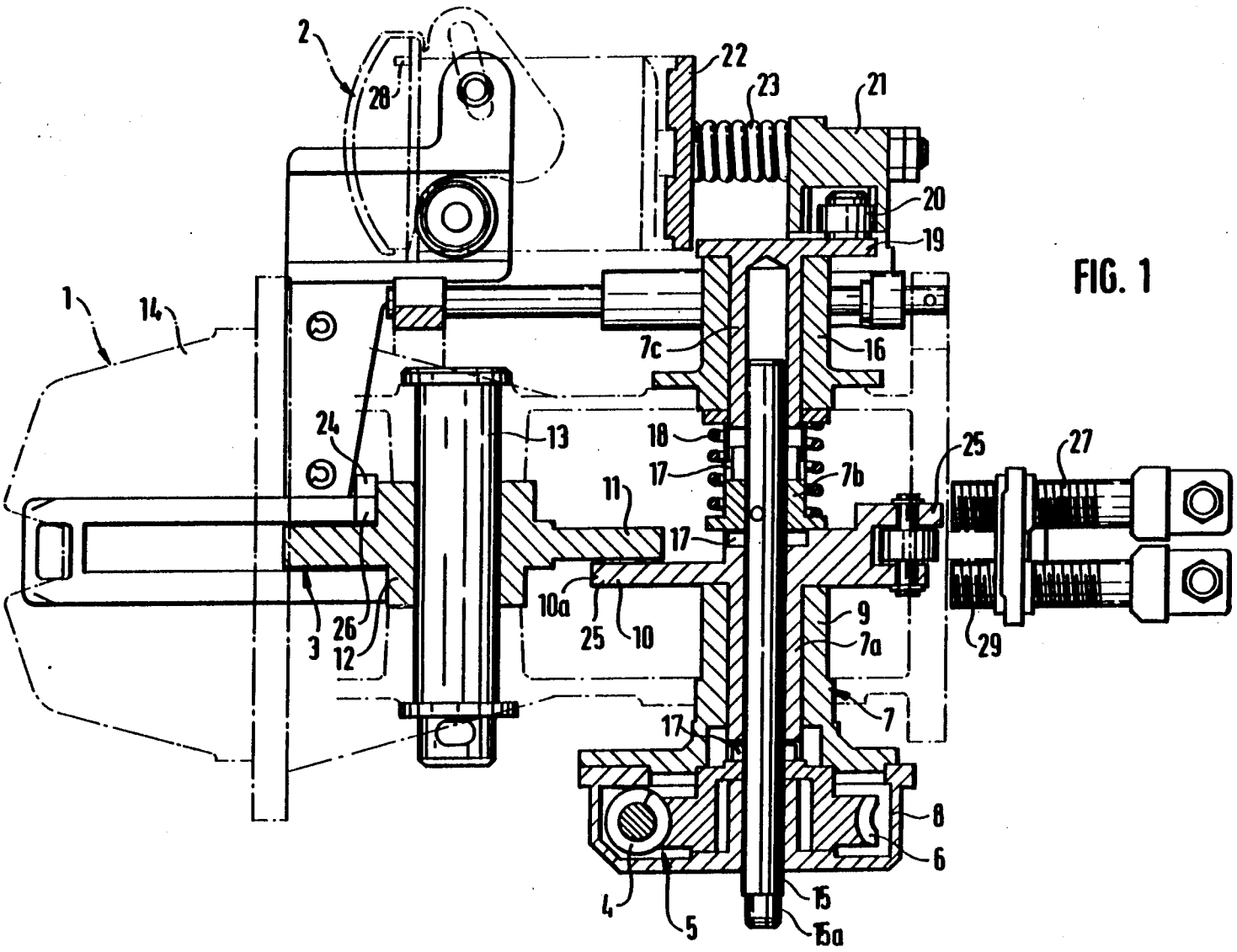
FIG. 1 shows a partially cut-away side view of a coupling and uncoupling device according to the present invention; and, FIG. 2 shows a representation of the movement processes and positions of the actuating arm and the uncoupling lever during and after the coupling and uncoupling process.

A cable coupling 2 guided longitudinally displaceably in the direction of the coupling axis is arranged on a mechanical middle or intermediate buffer coupling 1. In the embodiment shown, the cable coupling 2 is arranged and guided at the top on the middle buffer coupling. The cable coupling 2 and a mechanical lock 3 of the middle buffer coupling 1 are coupled with each other via a coupling and uncoupling device. The coupling and uncoupling device has a rotary drive 4 that can be switched in both directions of rotation, preferably in the form of an electric motor, which actuates both the cable coupling 2 and the mechanical lock 3 via a gear mechanism 5. The rotary drive 4 drives a gear 6 which is connected to a lower hollow shaft section *7a* of a hollow shaft 7 arranged at right angles to the coupling axis on a side for torque transmission.

The axis of rotation of the gear 6 and that of the hollow shaft section *7a* are congruent. The hollow shaft section *7a* is mounted at its outer jacket in a housing part 8. In the upper zone, the hollow shaft section *7a* of the hollow shaft 7 has an annular guideway 9 which is supported on the edge of the housing part 8 at the surface at which the hollow shaft section *7a* passes through the housing part 8. Above the housing part 8, an uncoupling lever 10 with a release cam 10*a* extends in the radial direction from the hollow shaft section *7a*, and the release cam 10*a* is arranged such that it can be brought into the zone of switching of a release member 11 of the mechanical lock 3. Furthermore, a control cam 25 is arranged on the hollow shaft section *7a* above the housing part 8.

The mechanical lock used in the embodiment shown is a lock with rotatable disk hook 12 which is mounted in the coupling head 14 by means of a main bolt 13. Couplings with disk hooks 12 are well-known, e.g., from West German Patent Specification No. DE-PS 188,845 or West German Patent Specification No. DE-PS 660,833.

A middle hollow shaft section *7b*, which is nonrotatably connected to a shaft 15, is arranged above the lower hollow shaft section *7a*. The shaft 15 is guided rotatably and longitudinally displaceably in the hollow shaft section *7a* and extends beyond the housing part 8 in the downward direction with a projection 15*a* and beyond the hollow shaft section *7b* in the upward direction into the zone of an upper hollow shaft section *7c*. The shaft 15 is mounted longitudinally displaceably in the hollow shaft section *7c*. The upper hollow shaft section *7c* is mounted with its outer jacket in an upper annular guideway 16 The hollow shaft sections *7a*, *7b*, and *7c* are provided at their respective opposite ends with locking members 17, which permit torque to be transmitted from the lower hollow shaft section *7a* to the upper hollow shaft section *7c* and the locking members 17 between the lower hollow shaft section *7a* and the middle hollow shaft section *7b* can be disengaged by longitudinal displacement against each other and against the force of a spring 18.

An actuating arm 19, which extends in the radial direction and is arranged on the axis of rotation, and is offset through an angle of, e.g., 90° relative to the uncoupling lever 10 for reasons of representation, is arranged nonrotatably at the upper end of the hollow shaft part *7c*. The necessity and the amount of an angular offset depend on the position of the release member 11 of the mechanical lock 3 within the range of rotation of the release cam 10*a* of the uncoupling lever 10. A guide member 20, which engages with a guide rail 21 arranged at right angles to the coupling axis, is arranged at the end of the actuating arm 19. A support block 22, which carries the electrical cable coupling 2, is arranged on the guide rail 21 on the side facing the coupling plane. The cable coupling 2 is arranged and guided longitudinally displaceably in the direction of the coupling axis at the top on the middle buffer coupling 1. To generate and reliably maintain the necessary contact pressure of the cable coupling 2 in the coupled state, a pressing spring 23 acting in the direction of the coupling axis is arranged between the support block 22 and the cable coupling 2.

The actuation of the electrical cable coupling 2 via the actuating arm is positively coupled by the hollow shaft 7 with the actuation of the release member 11 of the lock 3 via the coupling lever 10 of the middle buffer coupling 1.

It is advantageous to select the angle of rotation for the actuating arm 19 to be 180°, because it is now possible to reach the end position which the actuating arm 19 and consequently the cable coupling 2 coupled with it are to reach by a single rotation of the actuating arm 19 either to the left or to the right, without changing the angle of rotation.

A coupling and uncoupling process of the electrical cable coupling 2 and of the mechanical middle buffer coupling 1 will be described below especially with reference to FIG. 2. It is assumed that the middle buffer coupling 1 and the cable coupling 2 cooperate with an identical middle buffer coupling 1' and an identical cable coupling 2', respectively. Identical characteristics are designated by the same reference numerals with primes.

During the coupling of the middle buffer coupling 1 with a middle buffer coupling 1', parts of their mechanical locks 3 and 3' meet each other, and the locks 3 and 3' are transferred from the ready-to-couple position into the coupled position, in which they can be additionally secured by spring forces.

After completion of the locking process or in a close chronological relationship thereto, an initiating member 24' of the middle buffer coupling 1' energizes a switch 26 of the middle buffer coupling 1, and an initiating member 24 of the middle buffer coupling 1 energizes a switch 26' of the middle buffer coupling 1'. The processes taking place for coupling the electrical cable coupling 2 and 2' are the same on both coupling sides, so that explanations for only one coupling side are necessary to describe the coupling process.

The switch 26 initiates the rotary drive 4. Via the gear mechanism 5, the rotary drive 4 rotates the actuating arm 19 arranged on the shaft 15 according to FIG. 2 from position a) (uncoupled) into position c) (coupled) via position b) (coupling) through 180° in the counterclockwise direction. The actuating arm 19 with its guide member 20 extends into the guide rail 21, and during the rotation around the axis of the shaft 15, it displaces the cable coupling 2 from the rear end position into the intended front end position. The hollow shaft 7 rotated by the rotary drive 4 through 180° rotates the uncoupling lever 10, and the release cam 10*a* arranged on the release lever 10 does not engage with and does not release the lock 3 of the middle buffer coupling 1 in the case of this direction of rotation. After rotating through the intended angle of rotation, the control cam 25 connected to the hollow shaft section 7*a* reaches the switching zone of a limit switch 27, which is arranged in the middle buffer coupling 1 and initiates de- energization of the rotary drive 4. The cable coupling 2' is moved by the actuating arm 19 into the front end position (FIG. 2, *c*)). The processes taking place on the side of the middle buffer coupling 1' are identical.

Figure 2:
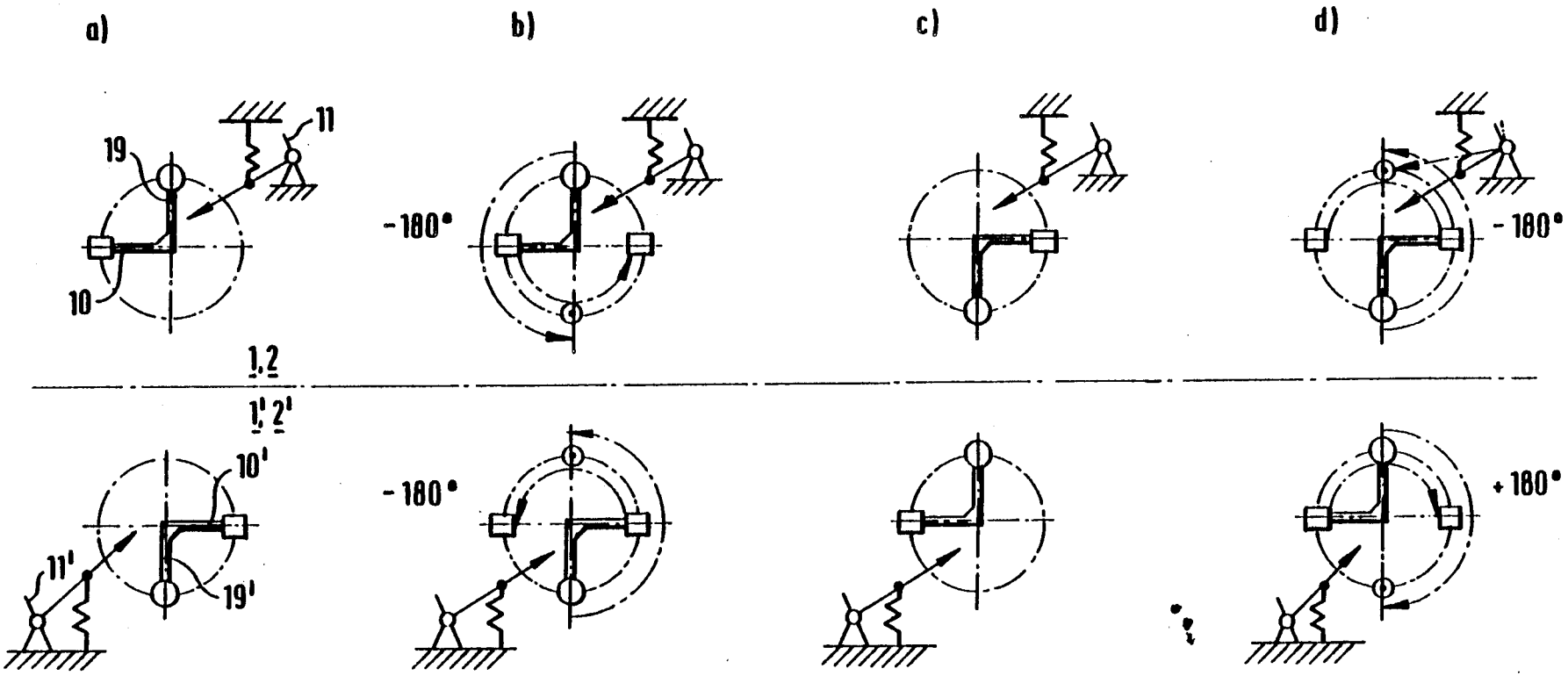

To initiate an uncoupling process on the side of the middle buffer coupling 1 via a control device (not shown) from the position shown in FIG. 2 (*c*) via the rotary movement according to FIG. 2 (*d*) into the position according to FIG. 2 (*a*), the actuating arm 19 is rotated in the same direction as during the coupling process via the hollow shaft sections 7*a*, 7*b*, and 7*c* after the rotary drive 4 has been turned on. Via the guide member 20 and the guide rail 23, the cable coupling 2 is displaced longitudinally rearward from the front end position from the coupling plane in the direction of its articulation. After displacement of the cable coupling 2 by at least a distance that is determined by the reliable separation of the electrical contacts of the cable coupling 2, the uncoupling lever 10, which is rotated in the same direction as the hollow shaft section 7*a*, releases, with the release cam 10*a* arranged on it, the lock 3 of the middle buffer coupling 1. On release of the lock 3 on the side of the coupling system formed by the middle buffer coupling 1 and 1', the coupling system is released and is, in principle, mechanically detachable. The uncoupling lever 10 is arranged as the leading lever in this direction of rotation according to FIG. 2 relative to the actuating arm 19, but, as was described above, the necessity and the amount of an angular offset depend on the position of the release member 11 in the range of rotation of the release cam 10*a*. The only thing that is essential for the function is that the release cam 10*a* shall actuate the release member 11 for releasing the lock 3 chronologically after the cable coupling 2 has been displaced by at least a distance that is determined by the reliable separation of the electrical contacts of the cable coupling. After the intended angle of rotation of 180° has been reached, the control cam 25 connected to the lower hollow shaft section 7*a* reaches the switching zone of a limit switch 29 of the control device and generates a switching impulse which initiates the turning off of the rotary drive 4 via the control device. The cable coupling 2 is moved into the rear end position. The uncoupling process at the middle buffer coupling initiating the uncoupling is thus complete.

On the side of the middle buffer coupling 1', the uncoupling process of the cable coupling 2' and of the middle buffer coupling 1' is initiated by the uncoupling process of the cable coupling 2 via a contact device 28, 28'.

The contact device 28' energizes the rotary drive 4', and its direction of rotation is now opposite the direction of rotation of the rotary drive 4 of the middle buffer coupling 1.

Via the gear mechanism 5', the rotary drive 4' acts on the actuating arm 19 arranged on the hollow shaft section 7'*c*. The direction of rotation of the hollow shaft section 7'*c* is opposite the direction of rotation of the hollow shaft section 7*c* of the middle buffer coupling 1. With its guide member 20', the actuating arm 19 extends into the guide rail 21', and during the rotation around the axis of the hollow shaft section 7'*c*, it displaces the cable coupling 2' into the intended rear end position. The uncoupling lever 10' connected to the hollow shaft section 7'*c* rotates in this direction of rotation, without the release cam 10'*a* actuating the release member 11 of the lock 3'. The positive coupling of the rotary movement of the actuating arm 19 and of the uncoupling lever 10 is designed such that it can be abolished. By raising the shaft 15, which is guided longitudinally displaceably in the hollow shaft section 7*a*, at the projection 15*a*, the hollow shaft section 7*b*, which is nonrotatably connected to it, is raised against the force of spring 18, and the locking members 17 between the lower hollow shaft section 7*a* and the middle hollow shaft section 7*b* thus become disengaged. Thus, the rotation of the actuating arm 19 and consequently a displacement of the cable coupling 2 can be carried out uncoupled from the rotary drive 4 and the uncoupling lever 10, and even manually. Rotation of the uncoupling lever 10 via the rotary drive 4 uncoupled from the actuating arm 19 is also possible in the raised position of the shaft 15. Manual, independent actuation of the lock, uncoupled from a remotely controllable coupling and uncoupling device, is also possible as usual to release the mechanical middle buffer coupling 1 via a hand lever (not shown).

It is also possible, in principle, to use the coupling and uncoupling device according to the present invention to actuate more than one cable coupling 2, e.g., two cable couplings 2 arranged next to each other or above and below the middle buffer coupling 1 by means of a branching gear mechanism (not shown) arranged between the uncoupling lever 10 and the actuating arms 19.

While a specific embodiment of the invention has been shown and described in detail to illustrate the application of the principles of the invention, it will be understood that the invention may be embodied otherwise without departing from such principles.

What is claimed is:

1. A coupling and uncoupling device for an electrical cable coupling and a mechanical middle buffer coupling for rail-borne vehicles, comprising: a mechanical middle buffer coupling arrangement including a mechanical lock with a release member, the release member having a switching zone for switching the state of the mechanical lock between a locked position and an unlocked position; an electrical cable coupling arrangement including an electrical cable coupling element movable between a coupled front end position and an uncoupled rear end position along a guide rail; an actuating arm connected to said cable coupling element and being connected to an actuating shaft, said actuating shaft being guided rotatably and longitudinally displacably in a hollow shaft, said hollow shaft including a lower hollow shaft section, a middle hollow shaft section and an upper hollow shaft section supported by a housing part, said actuating shaft having a projection extending in a downward direction beyond said housing part and extending in an upward direction beyond said middle hollow shaft section, into a zone of the upper hollow shaft section, said actuating shaft being guided longitudinally displacably but non rotatably in said upper hollow shaft section, said upper hollow shaft section being non rotatably connected to said actuating arm, said lower hollow shaft section being fixedly coupled with a rotary drive for transmission of torque, an uncoupling lever including a release cam non rotatably connected to said lower hollow shaft section for moving said release cam into the switching zone of the release member of the mechanical lock, said middle hollow shaft section being non rotatably connected to said shaft, arranged above the lower hollow shaft section, each of said hollow shaft sections including locking members at their respective ends for transmission of torque from the lower hollow shaft section to the upper hollow shaft section and a disengaging arrangement for disengaging the locking members between the lower hollow shaft section and the middle hollow shaft section including spring means, said middle hollow shaft section being axially displaceable via the actuation shaft in the direction of the upper hollow shaft section relative to the lower hollow shaft section against a force of said spring means.

2. A coupling and uncoupling device according claim 1, wherein said uncoupling level and said actuating lever are positively coupled via said actuation shaft and each of said hollow shaft sections, said release cam actuating said release member of said lock after the beginning of the displacement of the cable coupling element into the rear end position and after completion of the locking process of the mechanical middle buffer coupling or in close sequential relationship to said completion of the locking process, said actuating arm displacing the cable coupling element into the front end position.

3. A coupling and uncoupling device according to claim 1, wherein said rotary drive means is switchable between rotation in a first direction and rotation in a second direction.

4. A coupling and uncoupling device according to claim 1, wherein rotation of said shaft in either direction moves said cable coupling element between said rear end position and said front end position.

5. A coupling and uncoupling device according to claim 1, wherein the angle of rotation of said actuating arm to achieve one switching cycle is set at 180°.

6. A coupling and uncoupling device according to claim 1, wherein during rotation from an angular position the release cam occupies when the cable coupling element is in the front end position into an angular position the release cam occupies when the cable coupling element is in the rear end position, the release cam leaves non-actuated the release member for releasing the mechanical lock when the direction of rotation of the lower hollow shaft section is opposite the direction of rotation of the rotation of the lower hollow shaft during the coupling process.

7. A coupling and uncoupling device according to claim 1, further comprising at least one control cam non-rotatably connected to the lower hollow shaft section for rotation into a switching zone of at least one limit switch for switching off the rotary drive.

8. A coupling and uncoupling device according to claim 1, further comprising a branching gear mechanism for actuating more than one cable coupling, said branching gear mechanism being positioned between the uncoupling lever and the actuating arm.

* * * * *